US006892932B2

(12) United States Patent
Correll

(10) Patent No.: US 6,892,932 B2
(45) Date of Patent: May 17, 2005

(54) EFFICIENT FOOD CARTON

(76) Inventor: John D. Correll, 8459 Holly Dr., Canton, MI (US) 48187-4237

( * ) Notice: Subject to any disclaimer, the term of this patent is extended or adjusted under 35 U.S.C. 154(b) by 170 days.

(21) Appl. No.: 10/306,683

(22) Filed: Nov. 27, 2002

(65) Prior Publication Data

US 2004/0099720 A1 May 27, 2004

(51) Int. Cl.[7] ..... B65D 5/488; B65D 25/10

(52) U.S. Cl. ..... 229/120.18; 229/198.2; 229/904; 229/906; 229/933; 229/936

(58) Field of Search ..... 229/120.18, 123, 229/169, 178, 902, 198.2, 904, 906, 933, 935, 936; 206/562, 563, 564, 565

(56) References Cited

U.S. PATENT DOCUMENTS 2,375,843 A * 5/1945 Gottlieb ..... 229/120.18
2,924,372 A * 2/1960 Kirkeby ..... 206/563
3,005,584 A * 10/1961 Coe ..... 206/563
3,899,119 A * 8/1975 Roccaforte ..... 206/562
4,265,393 A * 5/1981 Orchard ..... 229/902
4,431,128 A * 2/1984 Dirico ..... 229/904
5,381,949 A * 1/1995 Correll ..... 229/198.2
5,549,241 A * 8/1996 Correll ..... 229/120.01
5,553,771 A * 9/1996 Correll ..... 229/198.2
5,657,925 A * 8/1997 Norris ..... 229/120.18
5,752,651 A * 5/1998 Correll ..... 229/935
5,788,081 A * 8/1998 Bates ..... 206/562
5,890,648 A * 4/1999 Cai ..... 229/904
6,213,389 B1 * 4/2001 Cai ..... 229/904
6,568,586 B1 * 5/2003 VanEsley et al. ..... 229/120.18

* cited by examiner

*Primary Examiner*—Gary E. Elkins

(57) ABSTRACT

A blank and carton that provides for efficient, cost-effective, sanitary packaging of food products such as breadsticks, chicken wings, pizza slices, and the like. Structural arrangements include (a) a flap-free side wall with a non-folding front-wall-engagement tab, (b) two mated blanks each having a side wall with a free rear end disposed at an acute angle to a bottom edge of the side wall, (c) a side-wall-locking ancillary panel for retaining a side wall of a carton in an upright position, (d) an article-retaining structure attached to a side wall, (e) three mated blanks each having an article-retaining structure attached to a side wall, with the blanks being matable in two mating relationships and alignable at the ends, (f) a closed carton having an article-retaining structure that's at least partially exposed to view, and (g) an article-retaining structure comprising a cup-holding panel attached to a top edge of a wall and having a hole-opening flap disposed in a downward-extending position and with an edge of the flap disposed in close proximity to the bottom panel, thereby providing support for the cup-holding panel.

47 Claims, 5 Drawing Sheets

EFFICIENT FOOD CARTON

FIELD OF THE INVENTION

This invention relates to packaging in general and in particular to cartons for food products such as pizza, breadsticks, chicken wings, and the like.

BACKGROUND OF THE INVENTION

In the pizza and food-to-go industries, millions of orders of side-item type products are sold each year. Examples of such products include breadsticks, chicken wings, and pizza slices. One of the most prevalent types of cartons used for packaging these products is the corrugated paperboard carton. This carton comes in both folder type and clamshell type. The folder type carton is shipped as a flat blank and then erected into a carton at the point of use (i.e., the pizzeria). The clamshell type carton is erected in the factory and then shipped as an open clamshell.

These cartons can be categorized into two groups based on status of wall engagement. The two groups are (1) wall-engaged cartons and (2) non-wall-engaged cartons. A "wall-engaged carton" is one in which at least two wall structures are engaged one to the other, such that when the cover of the carton is in opened disposition those two wall structures remain in an erected position. A "non-wall-engaged carton" is one in which none of the wall structures of the carton are engaged one to another.

Various structural arrangements can be used for engaging adjacent walls of a carton. Some arrangements allow for efficient erection of a blank into a box, others do not. One particular structure that allows for efficient erection of a box is a non-folding wall-engagement tab. This invention is disclosed in Correll U.S. Pat. No. 5,381,949 granted Jan. 17, 1995.

Another structural consideration for side-item cartons is having an article-retaining structure for holding a sauce cup, for example, as well as perhaps some other article. Many pizzerias pack one or more sauce cups with their side-item products. Traditionally these cups have been placed next to the food product. However, there are two problems with this. First, the sauce cup often gets greasy. Second, some health departments consider it to be unsanitary for articles handled by human hands to come into contact with a ready-to-eat food product. As a result, it would be desirable to have a way of packing sauce cups and other articles so that these articles are positioned out of contact with the food product.

One prior art box has been invented to address this problem. Known as the "Kickers Box," it is used by Domino's Pizza for packaging chicken strips (which the company calls Kickers™). Essentially, the Kickers Box is a small version of the company's hexagonal D-type pizza box except with a special compartment at the front third of the box for holding two sauce cups. The compartment is created by a plurality of three interconnected panels. The first panel is attached to the top edge of the front wall of the box and is disposed parallel to the bottom panel. It has two holes in it for holding two sauce cups. The second panel is attached to the first panel and is disposed perpendicular to the first panel and serves as support for the first panel. The third panel is attached to the second panel and is disposed perpendicular to the second panel and is tucked underneath the connecting panels that connect the two diagonal walls to the front wall structure of the box.

This box is particularly defined in VanEsley et al. U.S. Pat. No. 6,568,586 granted May 27, 2003.

However, the Kickers Box has at least three drawbacks. First, it consumes a relatively large amount of material and, therefore, is relatively expensive. Second, it contains numerous flaps and, therefore, is time-consuming and awkward to erect from a blank into a box. Third, after product has been placed into the box, closing the cover on the box can be time-consuming due to the many cover flaps that need to be manipulated for tuck-in. In view of these three problems, it would be desirable to have a carton for side-item products that is material-saving, cost efficient, and easy-to-handle.

One particular carton that has a small number of flaps and, thereby, is efficient for handling is a carton disclosed in Correll U.S. Pat. No. 5,752,651. However, even though it has only one cover flap, the side walls of the carton each have a flap attached to the front end which requires folding prior to erecting the blank into a box. Therefore, it would be desirable to have a carton with side walls free of flaps altogether. Another potential drawback of this carton is that it has no article-retaining structure for holding a sauce cup separately from the food product carried in the carton. As previously discussed, the Kickers Box has an article-retaining structure for holding a sauce cup. However, it requires substantial additional material in manufacture of the blank. So it would be desirable to have a carton with a material-efficient article-retaining structure.

In short, it would be highly desirable to provide a food carton that overcomes the above-described problems and drawbacks associated with packaging side-item products.

SUMMARY OF THE INVENTION

In general terms, my invention is a blank and carton that provides for efficient, cost-effective, and/or sanitary packaging of food products such as breadsticks, chicken wings, pizza slices, and the like.

In specific terms, my invention is a blank and carton that provides one or more of the following structural arrangements:

1. A configuration of two mated blanks each having a flap-free side wall with a non-folding front-wall-engagement tab projecting from a front end;

2. A configuration of two mated blanks each having a side wall with a free rear end disposed at an acute angle to a bottom edge of the side wall;

3. A blank having a side wall with a non-folding front-wall-engagement tab projecting from a front end and that's erectable (a) into a partially-erected carton having a front wall disposed in a particular first position and (b) into a fully-erected carton having the front wall disposed in a particular second position;

4. A carton having a side-wall-locking ancillary panel attached to a top edge of a front wall and capable of retaining a side wall of the carton in an upright position;

5. A carton having a first wall with a tab-receiving opening having an outside edge obliquely disposed to a bottom panel and, thereby, capable of causing an adjacent wall to be disposed at an oblique angle to the bottom panel;

6. Two mated blanks each having an article-retaining structure attached to a side wall, with the blanks being matable in a first mated relationship and also in a second mated relationship;

7. Three mated blanks each having an article-retaining structure attached to a side wall, with the blanks being matable in two mating relationships and alignable at the ends;

8. A blank for a carton having an article-retaining structure comprising a first panel attached to a top edge of a side wall.

9. A closed carton having an article-retaining structure that's exposed to view;

10. A carton having an article-retaining structure comprising a first panel attached to a top edge of a side wall and a second panel attached to the first panel.

11. A carton having an article-retaining structure comprising a cup-holding panel attached to a top edge of a wall and having a hole-opening flap disposed in a downward-extending position and with an edge of the flap disposed in close proximity to the bottom panel, thereby providing support for the cup-holding panel; and 12. A partially-erected open carton having an outward-extending non-deployed article-retaining structure attached to an upright wall, whereby the article-retaining structure is disposed outside of the holding cavity of the partially-erected carton.

My invention typically would be used for packaging food products such as breadsticks, chicken wings, pizza slices, and the like. However, it could take other forms for other purposes, as well.

A complete understanding of the invention can be obtained from the detailed description that follows.

OBJECT AND ADVANTAGES

The main object of my invention is a blank and carton that provides for efficient packaging of food products.

The advantages of my invention are (1) material savings, (2) cost savings, and (3) efficient carton handling operations.

Further objects and advantages of the invention will become apparent from consideration of the following detailed description, related drawings, and appended claims.

LIST OF REFERENCE NUMERALS

Figure 1:
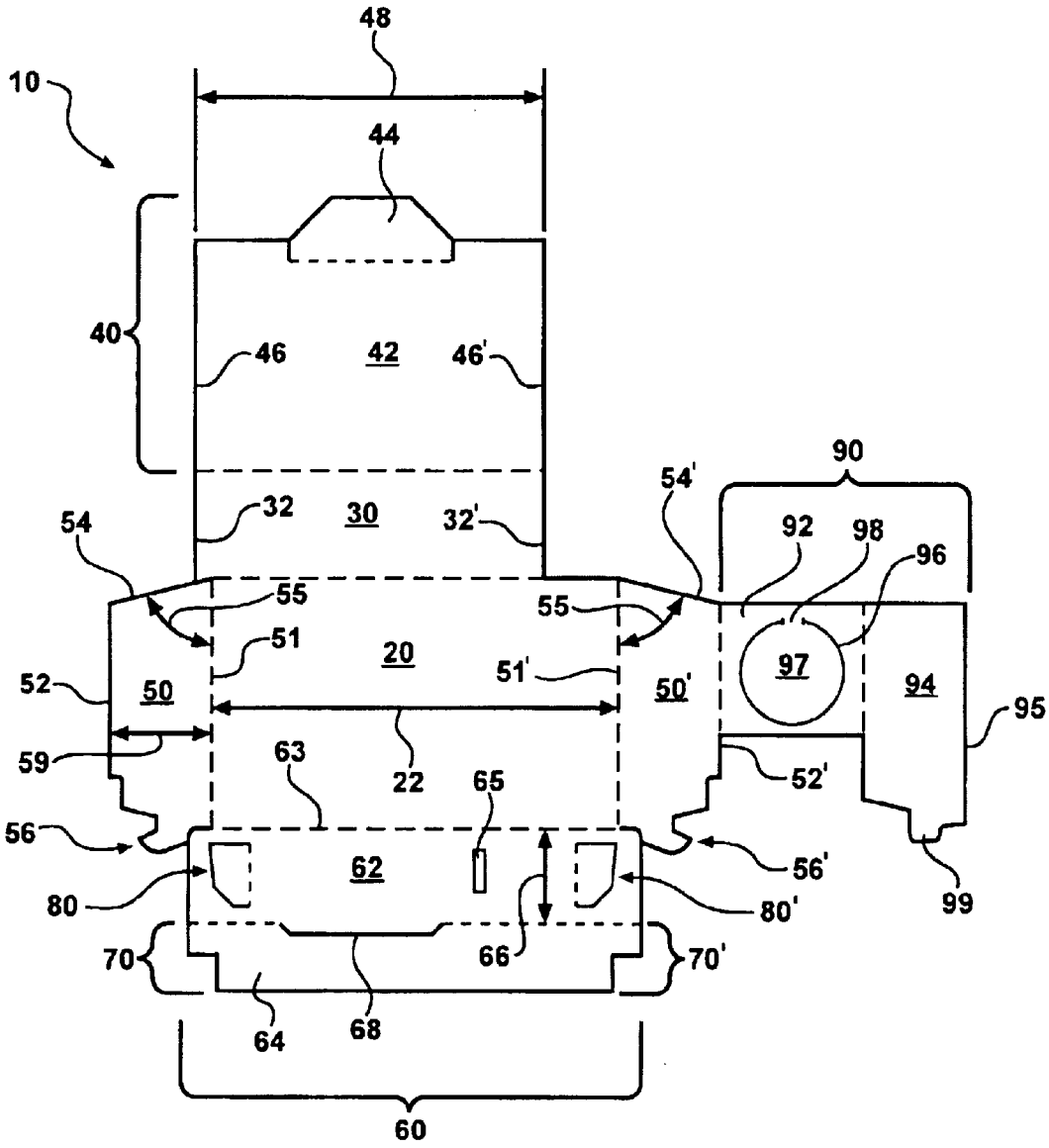
FIG. 1 is a plan view of the blank of the preferred embodiment.

Between drawings, like reference numerals designate corresponding parts.

10 blank of the preferred embodiment
12 carton of the preferred embodiment
20 bottom panel
22 left-to-right width of bottom panel
30 rear end wall
32, 32' free ends of rear end wall
40 cover
42 cover panel
44 cover front flap
46, 46' free side edges of cover panel
48 left-to-right width of cover panel and rear end wall
50, 50' side walls
51, 51' bottom edge of side walls
52, 52' top edge of side walls
54, 54' free rear end of side walls
55 acute angle
56, 56' non-folding front-wall-engagement tabs
57 hook portion
58 front-wall-retainable inside edge
59 height of side wall
60 front wall structure
62 front end wall
63 bottom edge of front end wall
64 ancillary panel
65 tab-receiving slot
66 height of front end wall
68 slot-forming slit
70, 70' end edges of ancillary panel
72 first portion of end edge
74 second portion of end edge
80, 80' tab-receiving openings
82 side-wall-retaining outside edge
84 swing flap
86 inside edge
90 article-retaining structure
92 first panel of article-retaining structure
94 second panel of article-retaining structure
95 outermost edge of article-retaining structure
96 cup-holder opening
97 hole-opening flap
98 bridge of material
99 tab
101 first blank
102 second blank
103 third blank
106 front end edge of blank
108 rear end edge of blank
110 first hole-opening flap
111 second hole-opening flap
120 acute angle
122 acute angle
124 oblique angle

DESCRIPTION OF THE PREFERRED EMBODIMENT

Referring now to the drawings, there is illustrated a preferred embodiment of the invention in the format of a one-piece paperboard blank and, correspondingly, in the format of a box created from the blank. The intended use for the embodiment is as a food carton or, specifically, as a carton for packaging side-items such as breadsticks, chicken wings, pizza slices, and the like. However, it will be appreciated, as the description proceeds, that my invention may be realized in different embodiments and may be used in other applications.

FIG. 1 shows a blank 10 and FIGS. 3–8 show various views of a carton 12 made from blank 10. Referenced components are labeled in FIGS. 1 and 2; selected components are labeled in other Figures. Corresponding parts between drawings share a same reference numeral. Pairs of opposing like components are to be found, with one item of the pair on each side of the blank or carton. For simplicity of labeling, each component of the opposing pair will have the same reference numeral, with the numeral for the second item of the pair also having a prime mark.

Structure of the Embodiment

Referring particularly to blank 10 of FIG. 1, there is a bottom panel 20, a rear end wall 30, a cover 40, opposing first and second side walls 50 and 50', a front wall structure 60, and an article-retaining structure 90.

Bottom panel 20 has a left-to-right width 22.

Rear end wall 30 has first and second free ends 32 and 32' and a left-to-right width 48 (indicated at the top of the drawing). It is noted that rear end wall width 48 is less than bottom panel width 22.

Cover 40 comprises a cover panel 42 attached to rear end wall 30 at a fold line and a cover front flap 44 attached to a front edge of cover panel 42 at a fold line. Cover panel 42 has opposing first and second free side edges 46 and 46'. Cover panel 42 has a left-to-right width 48. It is noted that cover panel width 48 is less than bottom panel width 22. It is also noted that cover panel 42 is a full-length cover panel, meaning that it spans the entire distance from rear end wall to front end wall in the carton format.

Figure 2:
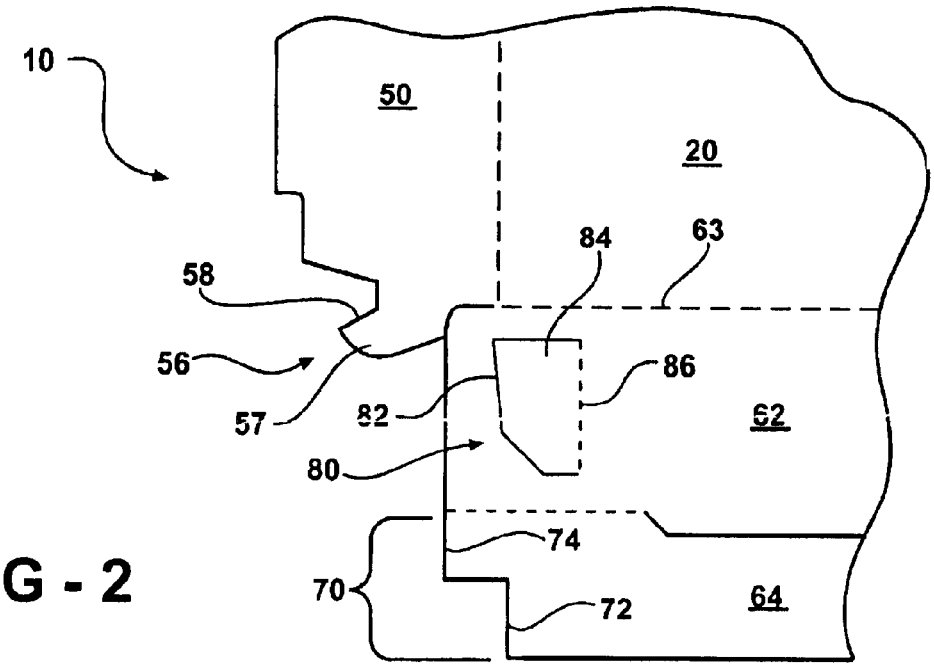
FIG. 2 is a front left corner section of the blank of FIG. 1.

Side walls 50, 50' are attached to bottom panel 20 at respective bottom edges 51 and 51'. The side walls also have top edges 52, 52' and free rear ends 54, 54', respectively. Free rear ends 54, 54' are disposed at an acute angle 55 to the bottom edge 51, 51'. In the case of side wall 50, it is noted that top edge 52 is a free top edge (meaning, free of attachment to another panel). The side walls also have non-folding front-wall-engagement tabs 56, 56' respectively projecting from a free front end of the side walls. As illustrated in FIG. 2, each of the tabs has a hook portion 57 and a front-wall-retainable inside edge 58. It is noted that tabs 56, 56' are non-folding, meaning that when the blank is erected into a carton these tabs do not undergo a folding operation. So these tabs are integral to the side walls and, accordingly, are not flaps appended to the side walls (which would require folding when erecting the blank into a box). As such, side wall 50 is a flap-free side wall that is free of attachment to any panel other than bottom panel 20. Side walls 50, 50' have a height 59 (shown only on side wall 50).

Front wall structure 60 comprises a front end wall 62 attached to bottom panel 20 at a bottom edge 63. Structure 60 further comprises an ancillary panel 64 attached to a top edge of front end wall 62 at a fold line. Front end wall 62 has a height 66. It is noted that height 66 is less than height 59 of side walls 50, 50'.

Positioned along the fold line joining ancillary panel 64 to front end wall 62 is a slot-forming slit 68 which opens into a slot for receiving cover front flap 44 when the blank is erected into a carton.

Figure 6:
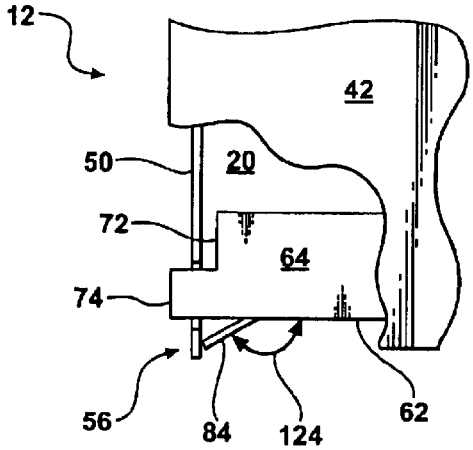
FIG. 6 is a top view of a left front corner section of the fully-erected carton with a portion of the cover panel removed.
Figure 7:
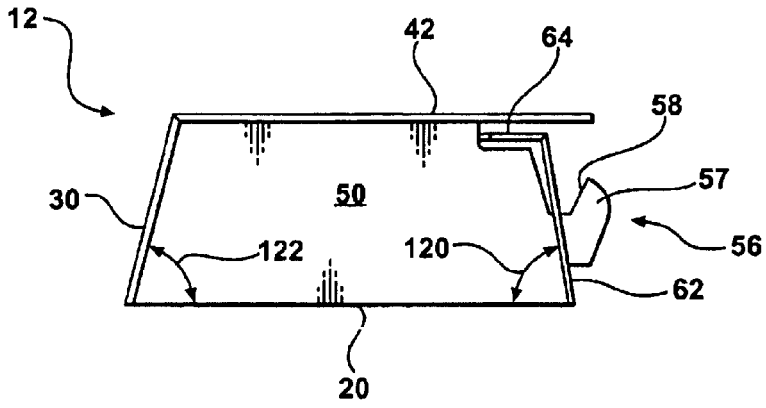
FIG. 7 is a left side elevation view of the fully-erected carton.

Ancillary panel 64 has opposing first and second end edges 70 and 70'. It is noted that ancillary panel 64 is a side-wall-locking ancillary panel. This is achieved by the special configuration of end edges 70, 70'. As illustrated in FIG. 2, each end edge of ancillary panel 64 comprises a first portion 72 and a second portion 74. When blank 10 is erected into the fully-erected carton 12, the first portion 72 is disposed interior to and in close proximity to one of side walls 50, 50'. Portion 72 also is disposed below the top edge (52 or 52') of the side wall. This is illustrated in FIGS. 6 and 7. This arrangement prevents the side walls from moving to an inward-slanting position when an inward-pushing force is applied to them. In addition, it is noted that second portion 74 is disposed exterior to the side wall.

Figure 3:
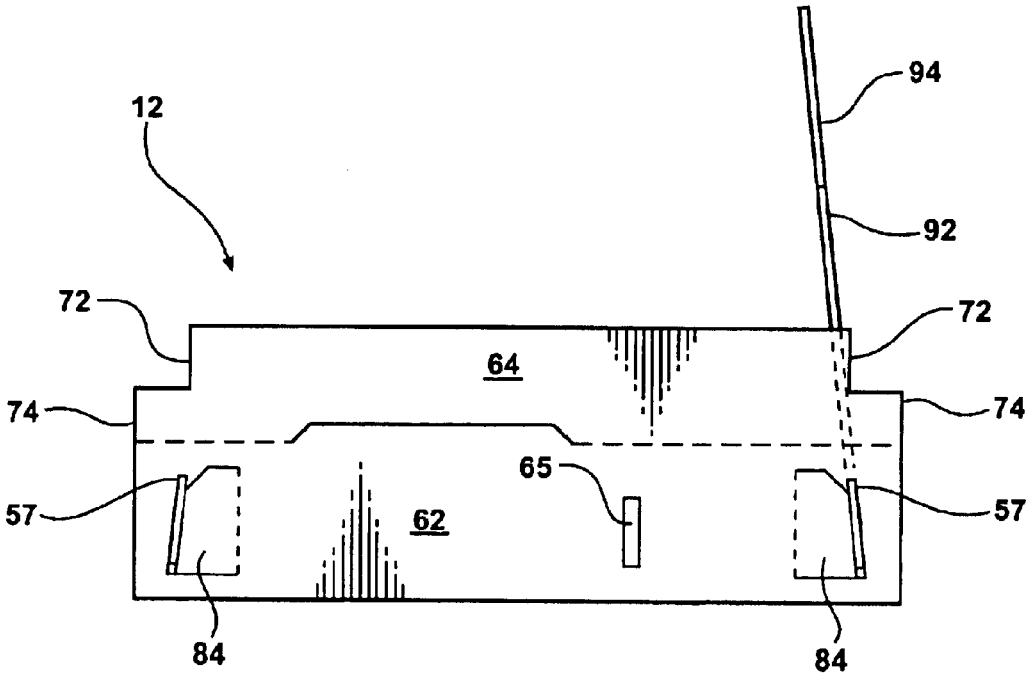
FIG. 3 is a front elevation view of a partially-erected carton made from the blank of FIG. 1.

Front end wall 62 comprises opposing first and second tab-receiving openings 80 and 80'. As illustrated in FIG. 2, each of the openings has a side-wall-retaining outside edge 82 and a swing flap 84 hingedly attached to an inside edge 86. When erecting blank 10 into carton 12, front-wall-engagement tabs 56, 56' are respectively inserted into tab-receiving openings 80, 80' and, thereby, push swing flaps 84 to an open position, as illustrated in FIG. 6. It is noted that outside edge 82 is obliquely disposed to bottom edge 63 (see FIG. 2). Specifically, edge 82 slopes inward from bottom to top. This results in the front end of side walls 50, 50' being disposed at a slight inward-sloping angle in the erected carton, as illustrated in FIG. 3. Finally, it is noted that carton 12 is a wall-engaged carton (because side walls 50, 50' are engaged with front end wall 62).

Front end wall 62 further comprises a tab-receiving slot 65 which serves to engage with article-retaining structure 90 in the erected carton.

Article-retaining structure 90 comprises a first panel 92 attached to top edge 52' of side wall 50' and a second panel 94 attached to panel 92. This two-panel arrangement constitutes a plurality of interconnected panels. It is noted that in the preferred embodiment this plurality of interconnected panels consists of two panels only. Panel 92 contains a cup-holder opening 96 and a hole-opening flap 97. Accordingly, this panel could be referred to as a "cup-holder panel." Flap 97 is hingedly attached to the edge of cup-holder opening 96 by a narrow bridge of material 98. When a sauce cup is inserted into opening 96, hole-opening flap 97 bends downward and assumes a vertical disposition with bridge of material 98 holding it in place. Second panel 94 has a tab 99 which inserts into tab-receiving slot 65 in front end wall 62 when blank 10 is erected into carton 12. This engages article-retaining structure 90 with front wall structure 60 and, thereby, serves to hold panel 94 in a vertical disposition in the erected carton. Article-retaining structure 90 has an outermost edge 95.

As the term is used herein, an "article-retaining structure" is any structural component of a blank or carton that is configured to hold a particular article, such as a sauce cup, in a substantially fixed position or within a particular confined area within the carton. An article-retaining structure typically comprises multiple interconnected panels, but it is possible for the structure to comprise only a single panel.

FIGS. 3–8 show various views of carton 12 (erected from blank 10). FIG. 3 in particular shows a front elevation view of the carton in partially-erected format (with the front end wall and side walls erected). As the term is used herein, a "partially-erected carton" is a carton that has at least one wall in upright position and has at least one other element, such as another wall or the cover panel, disposed in a non-upright or non-closed position.

FIG. 3 further shows article-retaining structure 90, or first and second panels 92 and 94, in an outward-extending non-deployed disposition. As the term is used herein, an article-retaining structure disposed in an "outward-extending non-deployed disposition" would be an article-retaining structure that is disposed outside of the holding cavity of a partially-erected carton or box. For example, in the partially-erected carton 12 shown in FIG. 3, panels 92 and 94 of the article-retaining structure are extending upwardly (and, hence, outside of the carton's holding cavity). Obviously, in this disposition the article-retaining structure would be non-deployed, or not holding any food-containing cup.

Figure 5:
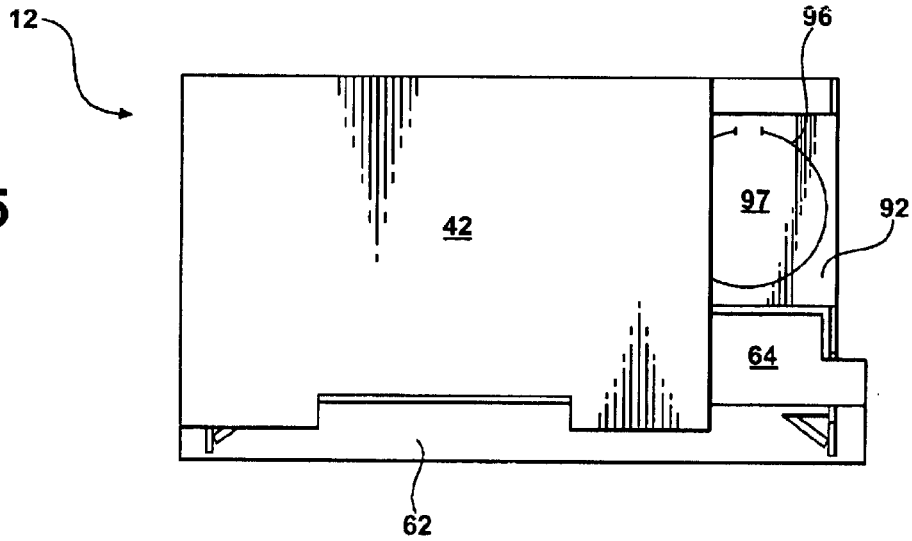
FIG. 5 is a top view of the fully-erected carton made from the blank of FIG. 1

In the preferred embodiment the outward-extending non-deployed article-retaining structure (i.e., panels 92, 94) is disposed coplanar to the wall panel (50'), to which it is attached. However, it's possible for the structure to assume other positions, such as extending outwardly at an angle to the wall panel. It is noted that such an outward-extending position would be considered to be an outward-extending non-deployed disposition and, thereby, within the scope of the definition. By comparison, FIG. 5 shows the article-retaining structure (i.e., panel 92) in a deployed disposition, or disposed within the holding cavity of the carton and capable of holding a food-containing cup. One purpose of having an article-retaining structure in an outward-extending non-deployed disposition is to enable the unobstructed placement of food product into the carton. Another possible purpose is to facilitate nesting or stacking of multiple open partially-erected cartons, as is often done with clamshell-style cartons.

Figure 4:
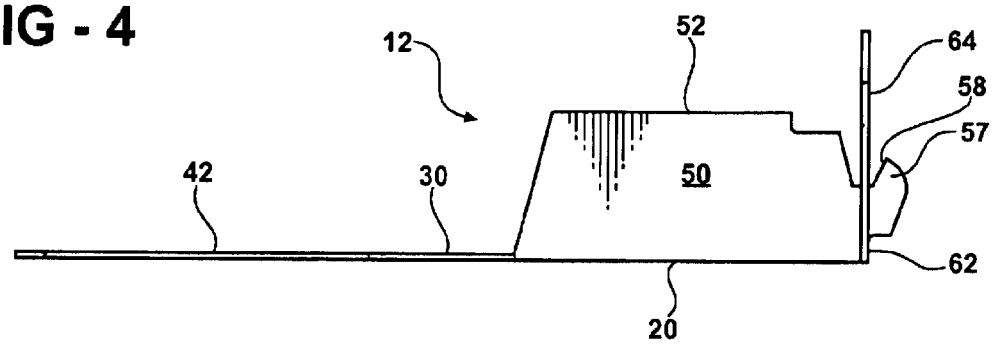
FIG. 4 is a left side elevation view of the partially-erected carton.

FIG. 4 shows a left side elevation view of the carton in partially-erected format (with the front end wall and side walls erected).

FIG. 5 shows a top view of the carton in fully-erected format. This view illustrates how cover panel 42 partially covers a portion of panel 92 of the article-retaining structure while also leaving a portion of panel 92 exposed to view. It is noted that cover panel 42 also covers a portion of cup-holder opening 96. This serves the purpose of preventing a sauce cup within the holder from falling out in transit.

FIG. 6 shows a top view of a left front corner section of the carton with a portion of the cover panel cut away. It is noted that swing flap 84 is disposed at an oblique angle 124 to front end wall 62 and is in contact with front-wall-engagement tab 56.

FIG. 7 shows a left side elevation view of the fully-erected carton. By comparing the position of front end wall 62 in FIG. 7 to that in FIG. 4, it is noted that front end wall 62 assumes a first position in FIG. 4 and a second position in FIG. 7. Specifically, in the partially-erected format (FIG. 4), front end wall 62 is disposed in contact with front-wall-retainable inside edge 58 of front-wall-engagement tab 56. However, in the fully-erected format (FIG. 7), front end wall 62 is disposed free of contact with front-wall-retainable inside edge 58. It is further noted that in the second position (FIG. 7), front end wall 62 slopes inward at an acute angle 120 to bottom panel 20. It is also noted that rear end wall 30 slopes inward at an acute angle 122 to bottom panel 20.

Figure 8:
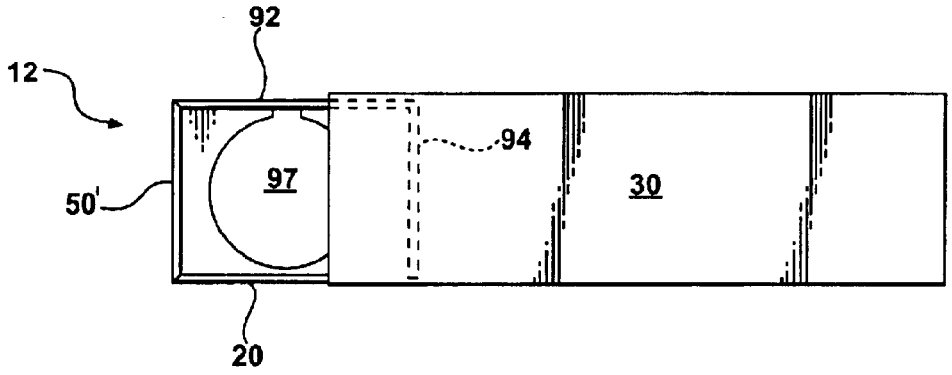
FIG. 8 is a rear elevation view of the fully-erected carton.

FIG. 8 shows a rear elevation view of the carton. It is noted that a portion of this rear side of the carton is open. This is because left-to-right width 48 of rear end wall 30 is less than left-to-right width 22 of bottom panel 20 (see FIG. 1). It is further noted that a bottom edge of hole-opening flap 97 is in close proximity to bottom panel 20. This serves the purpose of providing support for panel 92 if it should happen that a downward pressure is applied to panel 92. If it is desired to close off the opening at the rear of the carton, rear end wall 30 can be converted into a full-length rear wall by extending wall 30 over to side wall 50'. FIG. 8 also depicts the arrangement of panels 92 and 94 in the fully-erected format. Specifically, panel 92 is substantially parallel to bottom panel 20 and panel 94 is substantially perpendicular to panel 92.

Arrangement of Multiple Mated Blanks

Figure 10:
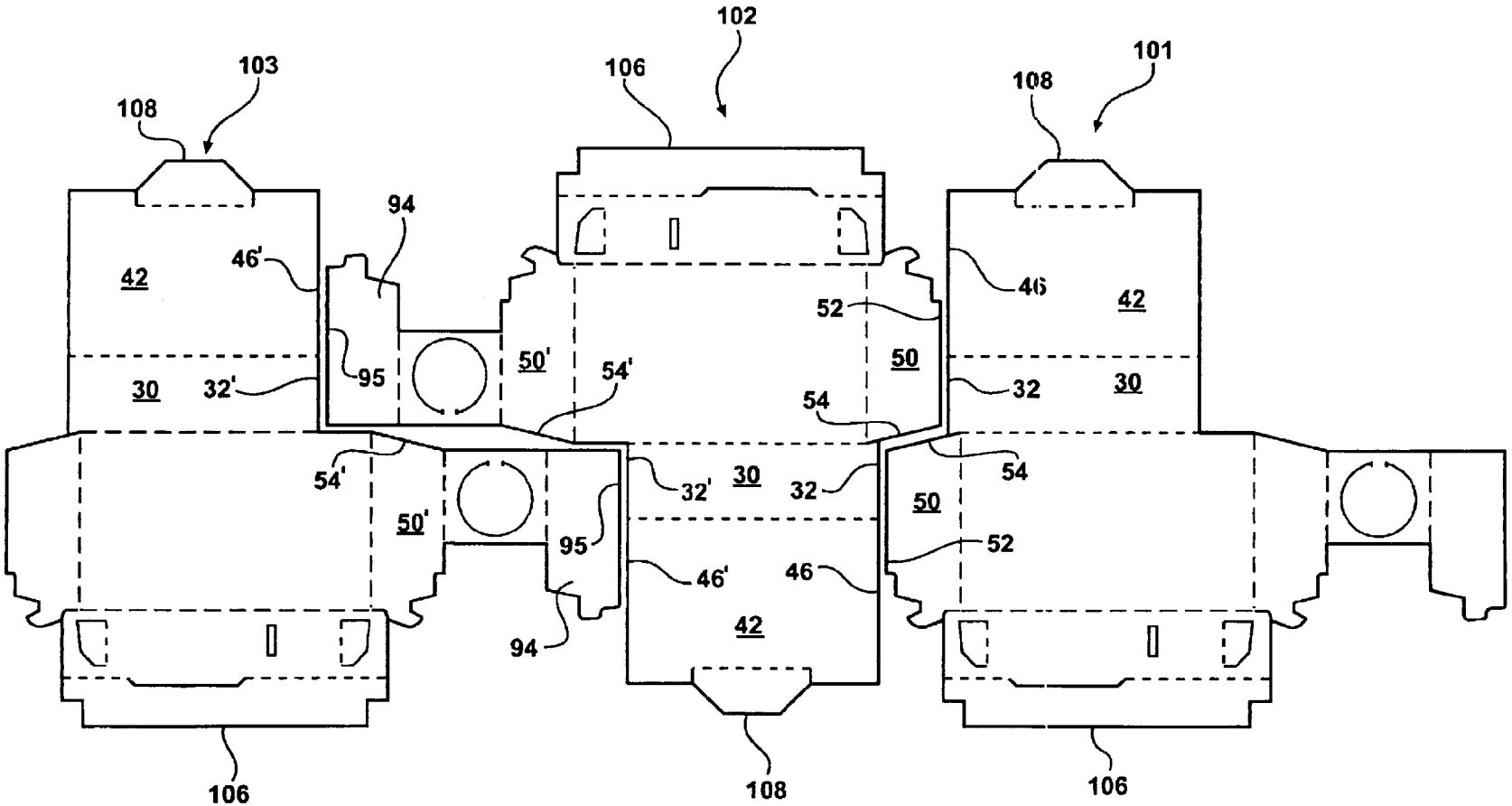
FIG. 10 is a plan view of three mated blanks of the preferred embodiment.

FIG. 10 shows three iterations of blank 10 in a mated configuration with adjacent blanks being oriented at 180 degrees to each other. For reference, the three iterations are labeled as blank 101, blank 102, and blank 103. This mated configuration is the preferred arrangement for achieving maximum material savings in manufacture of three or more units of blank 10. In the drawing of FIG. 10 a slight gap is provided between the blanks. This is for the purpose of achieving clarity of illustration. In reality, no such gap would likely exist.

Each of the blanks has opposite front and rear end edges 106 and 108, respectively, formed by furthermost extremities of the blank. It is noted that the end edges of one blank are substantially aligned with the opposite end edges of an adjacent blank. (In the drawing the end edges are not exactly aligned due to the gap between the blanks. Without the gap, however, the end edges should closely align.)

It is noted that between adjacent mated units of blank 10 two mating relationships are possible. The first relationship is depicted by blanks 101 and 102. The second relationship is depicted by blanks 102 and 103.

In the first mating relationship (between blanks 101 and 102), side wall 50 of each blank is disposed in a recess created by the other blank. The particular recess is created by free rear end 54 of side wall 50, free end 32 of rear end wall 30, and free side edge 46 of cover panel 42. It also is noted that there's an alternate way of describing this mating relationship, which is: At least a portion of top edge 52 of side wall 50 of each blank faces side edge 46 of cover panel 42 of the adjacent blank. Finally, it is noted that in each blank rear end 54 of side wall 50 is disposed at an acute angle to the bottom edge of the side wall (this acute angle is labeled as angle 55 in FIG. 1).

In the second mating relationship (between blanks 102 and 103), article-retaining structure 90 of the adjacent blanks are disposed adjacent one another. In this relationship at least a portion of outermost edge 95 of article-retaining structure 90 of each blank faces side edge 46' of cover panel 42 of the adjacent blank. It is also noted that there's an alternate way of describing this mating relationship, which is: Panel 94 of each blank is disposed in a recess created by rear end 54' of side wall 50', end 32' of rear end wall 30, and side edge 46' of cover panel 42 of the adjacent blank.

Possible Alternative Configurations

The foregoing describes the preferred embodiment of the invention. However, alternative configurations are possible, as follows.

A first alternative configuration would be to convert rear end wall 30 to a "full-length" rear wall that spans the entire distance between side walls 50, 50'. This might be done for the purpose of completely closing off the rear side of the carton.

Figure 9:
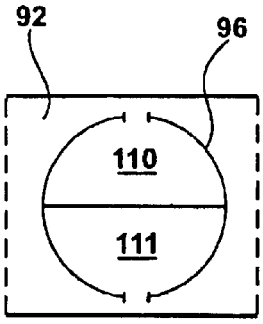
FIG. 9 is an alternate flap configuration for the cup-holder opening.

Another alternative configuration would be to replace the single hole-opening flap 97 with a multiple flap arrangement. An example is illustrated in FIG. 9, which shows first and second hole-opening flaps 110 and 111.

Another alternative configuration would be to construct panel 94 of the article-retaining structure so that it engages with rear end wall 30 instead of, or in addition to, engaging with front wall structure 60.

Operation of the Embodiment

Following is a procedure for erecting blank 10 into carton 12.

First, using both hands grasp the blank at the front ends of side walls 50, 50'. Hold the blank vertically with the outside facing you and the cover end down.

Second, simultaneously fold side walls 50, 50' inward to an acute angle (approximately 70 degrees) to bottom panel 20.

Third, while holding the side walls at the acute angle, fold front end wall 62 inward with your thumbs. End-wall-engagement tabs 56, 56' will push open swing flaps 84 and project through tab-receiving openings 80, 80'.

Fourth, while holding front end wall 62 down, simultaneously pull side walls 50, 50' outward until they abut side-wall-retaining outside edges 82, thereby causing the side walls to be held in an upright position. This also will cause tabs 56, 56' to hold front end wall 62 in an upright position, resulting in the partially-erected carton 12 depicted in FIGS. 3 and 4.

Fifth, fold article-retaining structure 90 inward and down until panel 92 is parallel to bottom panel 20 and panel 94 is perpendicular to panel 92 and tab 99 is engaged in tab-receiving slot 65.

Sixth, fold ancillary panel 64 downward and fold cover panel 42 forward and over the cavity of the carton and, finally, slide cover front flap 44 into slot 68 in front wall structure 60.

CONCLUSION, RAMIFICATIONS, AND SCOPE

I have disclosed a blank and carton that provides for efficient, cost-effective, sanitary packaging of food products such as breadsticks, chicken wings, pizza slices, and the like.

Within the drawing of the blank, a fold line between component parts of the invention is depicted with a dashed line. Within the context of this invention, a fold line can be created by a number of means such as, for example, by a crease or score in the board, by a series of aligned spaced short slits in the board, and by a combination of aligned spaced short and long slits. In conclusion, as referred to herein, a fold line is any line between two points on the blank or box along which the board is intended to be folded when the blank is being erected into a box or when the box is being manipulated as described herein. The type of fold lines shown in the drawings are presently preferred but it will be appreciated that other methods known to those skilled in the art may be used. As used herein, the term "hingedly attached" refers to two panels (or a panel and a flap) joined together at a fold line, and does not imply any degree of movability of the panels in the erected box format.

Within the foregoing discussion of the invention, the labeling of components as "first" and "second" is for reference purposes only and does not indicate any particular location of the components within the blank or carton.

The illustrated number, size, shape, type, and placement of components represent the preferred embodiment; however, many other combinations and configurations are possible within the scope of the invention. For example, the preferred embodiment of the invention is depicted as a folder-style carton. However, the particular aspect of the invention involving the article-retaining structure is applicable to clamshell-style cartons, as well, and if so applied would be considered to be within the scope of the invention. This also applies to blanks for clamshell-style cartons that have the particularly-defined article-retaining structure. Within the foregoing description of the invention and the subsequent claims, the term "cover" is used. Within the context of this description, the term "cover" refers to a cover panel and all flaps or panels attached to the cover panel (excluding, of course, a wall panel that would be attached to the bottom panel).

The foregoing discussion has pertained mainly to packaging for side-item food products. However, it should be realized that my invention could be used for other purposes, as well. In conclusion, it is understood that the invention is not to be limited to the disclosed embodiment but, on the contrary, is intended to cover various modifications and equivalent arrangements included within the spirit and scope of the appended claims, which-scope is to be accorded the broadest interpretation so as to encompass all such modifications and equivalent structures as is permitted under the law.

I claim:

1. Mated first and second blanks formed from a single sheet of foldable material, each of the blanks being erectable into a wall-engaged carton having at least one flap-free side wall, each of the blanks being cut and scored to define:

a bottom panel, a rear end wall hingedly attached to said bottom panel and having a free end, a cover comprising a full-length cover panel hingedly attached to said rear end wall and having a front edge and a first free side edge, a front wall structure opposing said rear end wall and comprising a front end wall hingedly attached to said bottom panel and having a free end, and a first side wall hingedly attached to said bottom panel at a bottom edge and comprising a free top edge, a free rear end disposed at an acute angle to said bottom edge, a free front end, and a non-folding front-wall-engagement tab projecting from said free front end, whereby said first side wall is free of attachment to any panel other than said bottom panel;

the blanks being oriented in a mated relationship with the first side wall of each blank being disposed within a recess created by the first free side edge of the cover panel, the free end of the rear wall, and the free rear end of the first side wall of the other blank, and each of the blanks having opposite front and rear end edges formed by furthermost extremities of the blank, the opposite end edges of each blank being substantially aligned with the opposite end edges of the other blank.

2. The first and second blanks of claim 1, wherein each of the blanks further comprises:

a second side wall opposing said first side wall and hingedly attached to said bottom panel and having a non-folding front-wall-engagement tab projecting from a free front end of the side wall, and an article-retaining structure hingedly attached to said second side wall, whereby after each of the blanks is erected into said wall-engaged carton said article-retaining structure is capable of holding an article in a substantially fixed position.

3. The first and second blanks of claim 1 wherein:

said front end wall of each of the blanks comprises a first tab-receiving opening having a side-wall-retaining outside edge, wherein said outside edge slopes inwardly from bottom to top.

4. Mated first and second blanks formed from a single sheet of foldable material, each of the blanks being erectable into a wall-engaged carton, each of the blanks being cut and scored to define:

a bottom panel, a rear end wall hingedly attached to said bottom panel and having a free end, a cover comprising a full-length cover panel hingedly attached to said rear end wall and having a front edge and a first free side edge and a cover front flap hingedly attached to said front edge, a front wall structure opposing said rear end wall and comprising a front end wall hingedly attached to said bottom panel and having a free end and an ancillary panel hingedly attached to a top edge of said front end wall, and a first side wall hingedly attached to said bottom panel at a bottom edge and having a free rear end;

the blanks being oriented in a mated relationship and each blank having opposite front and rear end edges formed by furthermost extremities of the blank, the opposite end edges of each blank being substantially aligned with the opposite end edges of the other blank, and the first side wall of each blank being disposed within a recess created by the first free side edge of the cover panel, the free end of the rear wall, and the free rear end of the first side wall of the other blank;

wherein the free rear end of said first side wall is disposed at an acute angle to the bottom edge of the side wall.

5. The first and second blanks of claim 4, wherein each of the blanks further comprises:

a second side wall opposing said first side wall and hingedly attached to said bottom panel and having a free rear end disposed at an acute angle to the bottom edge of the side wall, and an article-retaining structure hingedly attached to said second side wall, whereby after each of the blanks is erected into said wall-engaged carton said article-retaining structure is capable of holding an article in a substantially fixed position.

6. A blank for a wall-engaged carton having a front wall erectable into first and second positions, said blank being of foldable material cut and scored to define:

a bottom panel, opposing first and second side walls hingedly attached to said bottom panel and comprising respective first and second non-folding front-wall-engagement tabs projecting from respective first and second front ends of the side walls, the first and second tabs comprising respective first and second hook portions each having a front-wall-retainable inside edge, a front wall structure comprising a front end wall hingedly attached to said bottom panel and comprising opposing first and second tab-receiving openings having respective first and second side-wall-retaining outside edges, a rear end wall opposing said front end wall and hingedly attached to said bottom panel, and a cover comprising a cover panel hingedly attached to said rear end wall;

said blank being erectable into (a) a partially-erected carton having the front end wall disposed in a first position and (b) a fully-erected carton having the front end wall disposed in a second position, said first position having said first and second non-folding front-wall-engagement tabs respectively disposed within said first and second tab-receiving openings and the front end wall disposed in contact with the front-wall-retainable inside edge of each of the tabs, said second position having said first and second non-folding front-wall-engagement tabs respectively disposed within said first and second tab-receiving openings and the front end wall disposed free of contact with the front-wall-retainable inside edge of each of the tabs.

7. A fully-erected wall-engaged carton made of foldable material and comprising:

a bottom panel, a first side wall hingedly attached to said bottom panel at a bottom edge and having a top edge and opposing front and rear ends and comprising a non-folding end-wall-engagement tab projecting from at least one of the front end and the rear end, the tab comprising a hook portion having an end-wall-retainable inside edge, opposing front and rear end walls each hingedly attached to said bottom panel, at least one of the end walls comprising a tab-receiving opening having a side-wall-retaining outside edge, and a cover comprising a cover panel hingedly attached to said rear end wall and in a closed disposition on said carton;

said non-folding end-wall-engagement tab being disposed within said tab-receiving opening and said first side wall being in contact with said side-wall-retaining outside edge, wherein said at least one of the front end wall and the rear end wall is free of contact with the end-wall-retainable inside edge of said non-folding end-wall-engagement tab.

8. The carton of claim 7 wherein:

the top edge, the front end, and the rear end of said first side wall are free of attachment, whereby said first side wall is a flap-free side wall free of attachment to any panel other than said bottom panel.

9. The carton of claim 8 further comprising:

a second side wall opposing said first side wall and hingedly attached to said bottom panel and having a free rear end, and an article-retaining structure comprising a first panel hingedly attached to a top edge of said second side wall and having at least one cup-holder opening.

10. A fully-erected wall-engaged carton having a side-wall-locking front wall ancillary panel, said carton being made of foldable material and comprising:

a bottom panel, a rear end wall hingedly attached to said bottom panel, a cover comprising a cover panel hingedly attached to said rear end wall and having a front edge and opposing first and second free side edges, a first side wall hingedly attached to said bottom panel at a bottom edge and having a top edge, a rear end, and a free front end, and a front wall structure opposing said rear end wall and comprising a front end wall hingedly attached to said bottom panel and an ancillary panel hingedly attached to a top edge of said front end wall, said ancillary panel having opposing first and second end edges;

wherein at least a portion of the first end edge of said ancillary panel is disposed interior to and in close proximity to said first side wall and lower than the top edge of said first side wall, whereby the first end edge prevents said first side wall from moving to a substantially inward-sloping angle when the side wall receives an inward-pushing force.

11. The carton of claim 10 wherein:

said first end edge has another portion, said another portion being disposed exterior to the first side wall.

12. The carton of claim 10 wherein:

at least one of said front end wall and said rear end wall is disposed at an acute angle to said bottom panel.

13. The carton of claim 10 wherein:

both of said front end wall and said rear end wall are disposed at an acute angle to said bottom panel.

14. The carton of claim 10 wherein:

said first side wall has a free rear end and at least a portion of said free rear end is disposed at an acute angle to the bottom edge of the side wall.

15. The carton of claim 10 wherein:

the top edge and the rear end of said first side wall are free of attachment, whereby said first side wall is a flap-free side wall free of attachment to any panel other than said bottom panel.

16. The carton of claim 10 wherein:

said first side wall comprises a non-folding front-wall-engagement tab projecting from the free front end of the side wall, said front end wall comprises a tab-receiving opening, and said non-folding front-wall-engagement tab is disposed within said tab-receiving opening.

17. The carton of claim 16 wherein:

said tab-receiving opening has a swing flap hingedly attached to an inside edge of the opening and disposed at an oblique angle to said front end wall and in contact with said non-folding front-wall-engagement tab.

18. The carton of claim 16 wherein:

said non-folding front-wall-engagement tab comprises a hook portion having a front-wall-retainable inside edge, the front end wall being disposed free of contact with said front-wall-retainable inside edge.

19. A carton having a unique tab-receiving opening, said carton being of foldable material and comprising:

a bottom panel, a first wall comprising a non-folding wall-engagement tab projecting from an end of the first wall, and a second wall adjacent said first wall and having a bottom edge and comprising a tab-receiving opening having an inside edge and a wall-retaining outside edge opposing said inside edge and disposed laterally thereto;

the non-folding wall-engagement tab being disposed within said tab-receiving opening and contacting said wall-retaining outside edge, wherein said wall-retaining outside edge is obliquely disposed to the bottom edge of said second wall, whereby the end of said first wall is disposed at an oblique angle to said bottom panel.

20. The carton of claim 19 wherein:

said wall-retaining outside edge slopes inwardly from bottom to top, whereby the end of said first wall is caused to be disposed at an acute angle to said bottom panel.

21. Mated first and second blanks formed from a single sheet of foldable material, each of the blanks being erectable into a carton having at least one article-retaining structure, each of the blanks being cut and scored to define:

a bottom panel, a rear end wall hingedly attached to said bottom panel, a cover hingedly attached to said rear end wall, a front wall structure opposing said rear end wall and comprising a front end wall hingedly attached to said bottom panel, a first side wall hingedly attached to said bottom panel and having a top edge, a bottom edge, and a free rear end disposed at an acute angle to said bottom edge, a second side wall opposing said first side wall and hingedly attached to said bottom panel and having a top edge, a bottom edge, and a free rear end disposed at an acute angle to said bottom edge, and an article-retaining structure hingedly attached to said second side wall and having an outermost edge and comprising a first panel hingedly attached to the top edge of said second side wall and a second panel hingedly attached to said first panel, said first panel having at least one cup-holder opening, whereby after each of the blanks is erected into said carton said article-retaining structure is capable of holding an article in a substantially fixed position;

the blanks being oriented at one hundred eighty degrees from each other and disposed in one of a first and a second mated relationship, the first mated relationship having at least a portion of the top edge of the first side wall of the first blank facing an edge of the cover of the second blank, the second mated relationship having at least a portion of the outermost edge of the article-retaining structure of the first blank facing an edge of the cover of the second blank.

22. The first and second blanks of claim 21 wherein:

the mated relationship between the blanks is the first mated relationship.

23. The first and second blanks of claim 21 wherein:

the mated relationship between the blanks is the second mated relationship.

24. The first and second blanks of claim 21 wherein:

each of the blanks has opposite front and rear end edges formed by furthermost extremities of the blank, the opposite end edges of each blank being substantially aligned with the opposite end edges of the other blank.

25. The first and second blanks of claim 21 wherein:

said article-retaining structure of each of the blanks is engagable with at least one of said rear end wall and said front wall structure after the blank has been erected into said carton.

26. The first and second blanks of claim 21 wherein:

said at least one cup-holder opening of each of the blanks comprises one hole-opening flap hingedly attached to an edge of the opening.

27. The first and second blanks of claim 21 wherein:

said at least one cup-holder opening of each of the blanks comprises multiple hole-opening flaps each hingedly attached to an edge of the opening.

28. The first and second blanks of claim 21 wherein:

the cover of each of the blanks comprises a cover panel having a front edge and a free side edge disposed on a same side of the blank as said article-retaining structure.

29. The first and second blanks of claim 28 wherein:

the cover panel of each of the blanks has a predetermined left-to-right width and the bottom panel of each of the blanks has a predetermined left-to-right width, and the predetermined left-to-right width of the cover panel is substantially less than the predetermined left-to-right width of the bottom panel, whereby after each blank has been erected into a closed carton at least a portion of said article-retaining structure is exposed to view.

30. Mated first, second, and third blanks formed from a single sheet of foldable material, each of the blanks being erectable into a carton having at least one article-retaining structure, each of the blanks being cut and scored to define:

a bottom panel, a rear end wall hingedly attached to said bottom panel, a cover hingedly attached to said rear end wall, a front wall structure opposing said rear end wall and comprising a front end wall hingedly attached to said bottom panel, a first side wall hingedly attached to said bottom panel and having a top edge, a second side wall opposing said first side wall and hingedly attached to said bottom panel, and an article-retaining structure hingedly attached to said second side wall and having an outermost edge, whereby after each of the blanks is erected into said carton said article-retaining structure is capable of holding an article in a substantially fixed position;

the blanks being oriented in a mated configuration wherein, at least a portion of the top edge of the first side wall of the first blank faces an edge of the cover of the second blank, and at least a portion of the outermost edge of the article-retaining structure of the second blank faces an edge of the cover of the third blank.

31. The first, second, and third blanks of claim 30 wherein:

each of the blanks has opposite front and rear end edges formed by furthermost extremities of the blank, the opposite end edges of each blank being substantially aligned with the opposite end edges of the other blanks.

32. A blank for a carton having at least one article-retaining structure, said blank being of foldable material cut and scored to define:

a bottom panel, a rear end wall hingedly attached to said bottom panel, a cover hingedly attached to said rear end wall, a front wall structure opposing said rear end wall and comprising a front end wall hingedly attached to said bottom panel, opposing first and second side walls hingedly attached to said bottom panel, and an article-retaining structure comprising a plurality of interconnected panels consisting of a first panel hingedly attached to a top edge of said second side wall and a second panel hingedly attached to said first panel, said article-retaining structure having at least one cup-holder opening.

33. The blank of claim 32 wherein:

said article-retaining structure is engagable with at least one of said rear end wall and said front wall structure after the blank has been erected into said carton.

34. The blank of claim 32 wherein:

said at least one cup-holder opening comprises one hole-opening flap hingedly attached to an edge of the opening.

35. The blank of claim 32 wherein:

said at least one cup-holder opening comprises multiple hole-opening flaps each hingedly attached to an edge of the opening.

36. The blank of claim 32 wherein:

said cover comprises a cover panel having at least one free side edge, the cover panel and the bottom panel each has a predetermined left-to-right width, and the predetermined left-to-right width of the cover panel is substantially less than the predetermined left-to-right width of the bottom panel, whereby after the blank has been erected into a closed carton at least a portion of said article-retaining structure is exposed to view.

37. The blank of claim 32 wherein:

said cover panel has opposing first and second free side edges.

38. A fully-erected closed carton having an exposed article-retaining structure, said carton being of foldable material and comprising:

a bottom panel, opposing first and second side walls attached to said bottom panel, opposing front and rear end walls attached to said bottom panel, an article-retaining structure comprising a first panel attached to a top edge of one of the first and second side walls and disposed substantially parallel to said bottom panel, said first panel having at least one cup-holder opening, and a cover attached to said rear end wall and comprising a cover panel disposed substantially parallel to said bottom panel and of a configuration wherein at least a portion of the first panel of said article-retaining structure is free of coverage by said cover panel and said cover panel overlies a portion of said at least one cup-holder opening and another portion of said at least one cup-holder opening is free of coverage by said cover panel, whereby when said cup-holder opening contains a sauce cup a portion of the top of the sauce cup is exposed to view while, concurrently, the sauce cup is prevented from coming out of the opening by the cover panel.

39. The carton of claim 38 wherein:

said rear end wall is disposed at an acute angle to said bottom panel.

40. A fully-erected carton having an article-retaining structure, said carton being of foldable material and comprising:

a bottom panel, a rear end wall attached to said bottom panel, a cover attached to said rear end wall, a front wall structure opposing said rear end wall and comprising a front end wall attached to said bottom panel, opposing first and second side walls attached to said bottom panel, and an article-retaining structure comprising a plurality of interconnected panels consisting of a first panel attached to a top edge of said second side wall and disposed substantially parallel to said bottom panel and a second panel attached to said first panel and disposed substantially perpendicular thereto, said first panel having at least one cup-holder opening.

41. The carton of claim 40 wherein:

said article-retaining structure is engaged with at least one of said rear end wall and said front wall structure, whereby said article-retaining structure is held in a substantially fixed position.

42. The carton of claim 40 wherein:

said at least one cup-holder opening comprises one hole-opening flap hingedly attached to an edge of the opening.

43. The carton of claim 40 wherein:

said at least one cup-holder opening comprises multiple hole-opening flaps each hingedly attached to an edge of the opening.

44. The carton of claim 40 wherein:

the cover comprises a cover panel having at least one free side edge, the cover panel and the bottom panel each has a predetermined left-to-right width, and the predetermined left-to-right width of the cover panel is substantially less than the predetermined left-to-right width of the bottom panel, whereby at least a portion of said article-retaining structure is exposed to view.

45. The carton of claim 40 wherein:

said rear end wall has a predetermined left-to-right width and said bottom panel has a predetermined left-to-right width, the predetermined left-to-right width of said rear end wall being less than the predetermined left-to-right width of said bottom panel, whereby a portion of a rear side of said carton is open.

46. A blank for a carton having a unique tab-receiving opening, said blank being of foldable material cut and scored to define:

a bottom panel, a first wall hingedly attached to said bottom panel and comprising a non-folding wall-engagement tab projecting from an end of the first wall, and a second wall adjacent said first wall and hingedly attached to said bottom panel at a bottom edge and having a top edge opposing said bottom edge, said second wall comprising a tab-receiving opening having an inside edge and a wall-retaining outside edge opposing said inside edge and disposed laterally thereto;

wherein said wall-retaining outside edge slopes inwardly from bottom to top.

47. A fully-erected carton made of foldable material and comprising:

a bottom panel, a rear end wall attached to said bottom panel and having a free end, a front wall structure opposing said rear end wall and comprising a front end wall attached to said bottom panel and having a free end and an ancillary panel attached to a top edge of said front end wall, a first side wall disposed adjacent said rear end wall and attached to said bottom panel at a bottom edge and having a free rear end, and a cover comprising a full-length cover panel attached to said rear end wall and having a front edge and a first free side edge and a cover front flap hingedly attached to said front edge, said cover panel overlying a top edge of said first side wall;

wherein the free rear end of said first side wall is disposed at an acute angle to the bottom edge of the side wall.

* * * * *